US005106700A

United States Patent [19]

Bailey

[11] Patent Number: 5,106,700

[45] Date of Patent: Apr. 21, 1992

[54] CASTING WITH POLISHED RAISED LOGO AND METHOD OF MANUFACTURE

[75] Inventor: Francis V. Bailey, Racine, Wis.

[73] Assignee: Outboard Marine Corporation, Waukegan, Ill.

[21] Appl. No.: 521,673

[22] Filed: May 10, 1990

[51] Int. Cl.[5] ..... B22D 31/00

[52] U.S. Cl. ..... 428/601; 428/687; 29/527.6; 164/69.1

[58] Field of Search ..... 29/527.6; 249/103, 104; 164/262, 264, 69.1, 70.1; 428/687, 601, 600

[56] References Cited

U.S. PATENT DOCUMENTS

| | | | |
|---|---|---|---|
| 1,561,427 | 11/1925 | Forsberg | 249/103 |
| 4,715,424 | 12/1987 | Brown et al. | 164/264 |

FOREIGN PATENT DOCUMENTS

| | | | |
|---|---|---|---|
| 510538 | 4/1952 | Belgium | 164/111 |
| 219404 | 3/1985 | German Democratic Rep. | 164/264 |

OTHER PUBLICATIONS

Automotive Engineering, vol. 96, No. 5, May 1988, p. 98.
Automotive Engineering, vol. 96, No. 11, Nov. 1988, p. 106.
Automotive Engineering, Oct. 1988, p. 6.
Hot Rod, Sep. 1988, p. 107.
Hot Rod, Sep. 1988, p. 73.
Hot Rod, Dec. 1988, p. 32.
Hot Rod, Dec. 1988, p. 100.
Hot Rod, Sep. 1988, p. 67.
Car & Driver, Oct. 1984, p. 95.
Car & Driver, Oct. 1984, Toyota Ad.
Car & Driver, Oct. 1984, p. 38.

*Primary Examiner*—John Zimmerman
*Attorney, Agent, or Firm*—Michael, Best & Friedrich

[57] ABSTRACT

Disclosed hereis is a casting having a cast exterior surface and a gate portion extending adjacently and integrally from the cast exterior surface and including a polished outer face located in adjacently raised relation to the cast exterior surface and having a perimeter or outline defining a desired indicia. The casting is produced by a method comprising the steps of forming a casting with a cast exterior surface and a gate which extends from the cast exterior surface and which includes a gate portion located adjacent the cast exterior surface and defined by an outline in the form of the desired indicia and a projection portion extending from the gate portion, severing the gate to remove the projecting portion, to retain, as part of the casting, the adjacent gate portion, and to provide a surface raised with respect to the cast exterior surface and having the outline in the form of the desired indicia, and polishing the raised surface.

2 Claims, 1 Drawing Sheet

CASTING WITH POLISHED RAISED LOGO AND METHOD OF MANUFACTURE

BACKGROUND OF THE INVENTION

The invention relates generally to casting techniques and to manufacturing processes for fabricating castings with an indicia such as a company logo, or trademark, or other indicia.

REFERENCE TO THE PRIOR ART

In the past, castings have been poured to produce a cast part and an integrally extending connected gate. In some instances, the cast part was gated directly into a cast exterior surface. Consequently, when the gate was subsequently severed from the cast exterior surface, there undesirably resulted an area which sometimes had a ragged appearance, and which, in any event, had an appearance different from the surrounding as-cast exterior surface. In the past, this gate area was finished or polished to remove the ragged effect or different appearance and to effect smooth merger with the surrounding cast exterior surface. However, there remained an undesirable transition between the polished area and the surrounding cast exterior surface. As a consequence, the gate area and the entire surrounding cast exterior surface were polished to provide a resulting surface with a uniform appearance and to remove any indication of the previously existing gate.

SUMMARY OF THE INVENTION

The invention provides a casting having a cast exterior surface and a gate portion extending adjacently and integrally from the cast exterior surface and including a polished outer face located in adjacently raised relation to the cast exterior surface and having a perimeter defining a desired indicia.

The invention also provides a casting having a cast exterior surface, a gate portion extending adjacently and integrally from the cast exterior surface and having an outline defining a cross section in the form of a desired indicia, and a projecting gate portion which extends from the adjacent gate portion.

In one embodiment of the invention, the projecting gate portion includes therein a recess and has a cross-section of lesser dimension than the cross-section of the adjacent gate portion.

The invention also provides a method of manufacturing a casting having a raised and polished surface with an outline in the form of a desired indicia, the method comprising the steps of forming a casting with a cast exterior surface and a gate which extends from the cast exterior surface and which includes a gate portion located adjacent the cast exterior surface and defined by an outline in the form of the desired indicia and a projecting portion extending from the gate portion, severing the gate to remove the projecting portion, to retain, as part of the casting, the adjacent gate portion, and to provide a surface raised with respect to the cast exterior surface and having the outline in the form of the desired indicia, and polishing the raised surface.

Other features and advantages of the invention will become apparent to those skilled in the art upon review of the following detained description, claims, and drawings.

Figure 1:
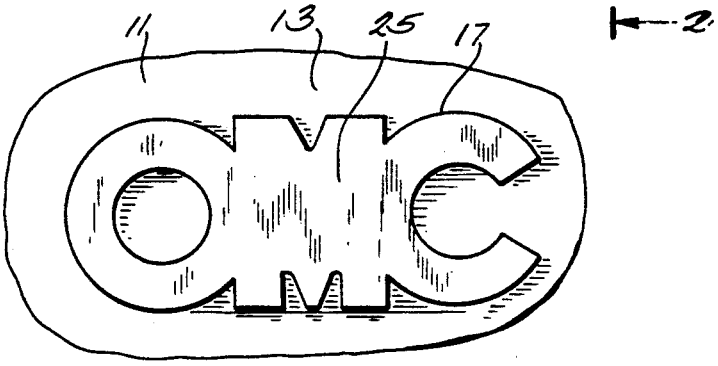
FIG. 1 is a fragmentary view of a casting embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 2:
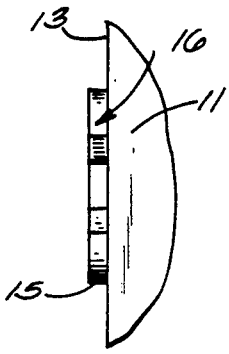
FIG. 2 is an end view taken along line 2—2 of FIG. 1.

Shown in FIGS. 1 and 2 is a casting 11 which can be cast from any suitable metal, which can be of any desired shape or form and which includes an as-cast exterior surface 13 and an adjacent portion 15 of a gate 16 extending outwardly from the as-cast exterior surface and having an outline or perimeter 17 in the form of a desired indicia, such as a company or other logo, as for instance, OMC. The casting 11, as initially cast (see FIG. 3), also includes a projecting gate portion 21 which projects from the adjacent gate portion 15 and which can have an outline 23 of lesser dimension than the adjacent gate portion 15 so as to facilitate location of the casting 11 relative to a saw or other blade (not shown) and thereby to facilitate severance adjacent the joinder of the projecting gate portion 21 and the adjacent gate portion 15. Removal of the projecting gate portion from the adjacent gate portion produces a raised outer face, surface, or area 25 located on the adjacent gate portion 15, which raised surface 25 is then polished, as by sanding or by any other suitable method. As a result, in the casting 11, the as-cast exterior surface 13 remains as-cast and the adjacent gate portion includes, in contrast to the as-cast exterior surface 13, the raised and polished area or surface 25 having the outline 17 in the form of the desired indicia, for example, the illustrated OMC.

Figure 3:
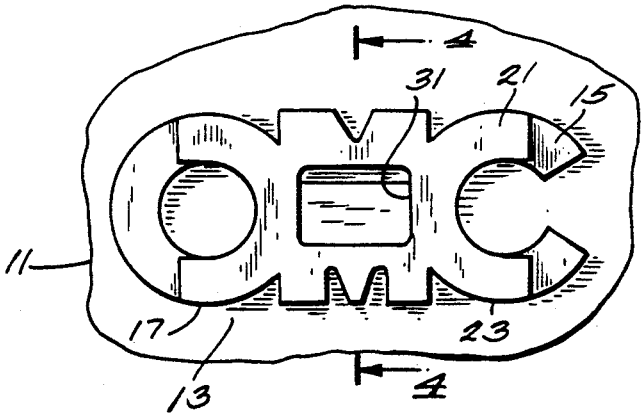
FIG. 3 is a fragmentary view similar to FIG. 1 and illustrating the casting of FIG. 1 at a earlier stage in the production thereof.
Figure 4:
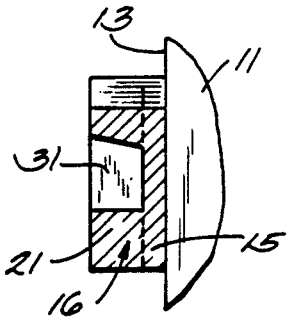
FIG. 4 is a sectional view taken along line 4—4 of FIG. 3.

As shown in FIG. 3 the projecting gate portion 21 can be centrally recessed as shown at 31 and the outline 23 thereof can be of a dimension less than the outline 17 of the adjacent gate portion 15 so as to reduce the amount of cast metal and, as already indicated, to facilitate removal of the projecting gate portion 21 from the adjacent gate portion 15. In addition, the recess 31 can be employed to receive a projecting portion of a foam runner (not shown).

Various of the features of the invention are set forth in the following claims.

I claim:

1. A casting having a cast exterior surface, a gate portion extending adjacently and integrally from said cast exterior surface and having an outline defining a cross section in the form of an indicia, and a projecting gate portion which extends from said adjacent gate portion and which has a cross-section of lesser dimension than said cross-section of said adjacent gate portion and includes therein a recess.

2. A method of manufacturing a casting having a raised and polished surface with an outline in the form of an indicia, said method comprising the steps of forming a casting with a cast exterior surface and a gate which extends from the cast exterior surface and which includes a gate portion located adjacent the cast exterior surface and defined by an outline in the form of the indicia and a projecting portion extending from the gate portion, severing the gate to remove the projecting portion and to retain, as part of the casting, the adjacent gate portion and to provide a surface raised with respect to the cast exterior surface and having the outline in the form of the indicia, and polishing the raised surface.

* * * * *